US006345828B1

(12) United States Patent
Pool et al.

(10) Patent No.: US 6,345,828 B1
(45) Date of Patent: Feb. 12, 2002

(54) MECHANIC'S CREEPER CONSTRUCTION

(75) Inventors: James L. Pool, Clarinda, IA (US); Craig L. Wallin, Logan, UT (US)

(73) Assignee: Lisle Corporation, Clarinda, IA (US)

( * ) Notice: Subject to any disclaimer, the term of this patent is extended or adjusted under 35 U.S.C. 154(b) by 0 days.

(21) Appl. No.: 09/925,242

(22) Filed: Aug. 8, 2001

Related U.S. Application Data

(63) Continuation of application No. 09/527,547, filed on Mar. 16, 2000, now abandoned, which is a continuation of application No. 09/065,707, filed on Apr. 24, 1998, now abandoned.

(51) Int. Cl.[7] ..... B25H 5/00
(52) U.S. Cl. ..... 280/32.6; 280/79.11
(58) Field of Search ..... 280/32.6, 79.11, 280/35; 108/57.28, 57.18; 248/129, 903; 16/38, 39

(56) References Cited

U.S. PATENT DOCUMENTS

D152,008 S * 12/1948 Lucas ..... 280/32.6
4,721,316 A * 1/1988 Whiteside ..... 280/32.6
4,792,147 A * 12/1988 Wissing ..... 280/32.6
D354,599 S * 1/1995 Young ..... D34/23
5,494,305 A * 2/1996 Chen ..... 280/32.6
5,527,051 A * 6/1996 Plaza ..... 280/32.6
5,594,974 A * 1/1997 Wattron et al. ..... 16/30
5,624,126 A * 4/1997 Vosbikian et al. ..... 280/32.6
6,024,376 A * 2/2000 Golichowski et al. ... 280/655.1

FOREIGN PATENT DOCUMENTS

DE 811436 * 6/1951 ..... 280/32.6
GB 2178702 * 2/1987 ..... 280/32.6

* cited by examiner

*Primary Examiner*—J. J. Swann
*Assistant Examiner*—David R. Dunn
(74) *Attorney, Agent, or Firm*—Banner & Witcoff, Ltd.

(57) ABSTRACT

A mechanic's creeper includes a molded plastic platform with casters connected at the periphery of the platform. The platform includes molded indentations in its bottom layer which merge into the top layer in an array which enhances the structural integrity of the platform. The platform further includes distinct sections for support of head, shoulders, lumbar and buttocks of a user.

4 Claims, 6 Drawing Sheets

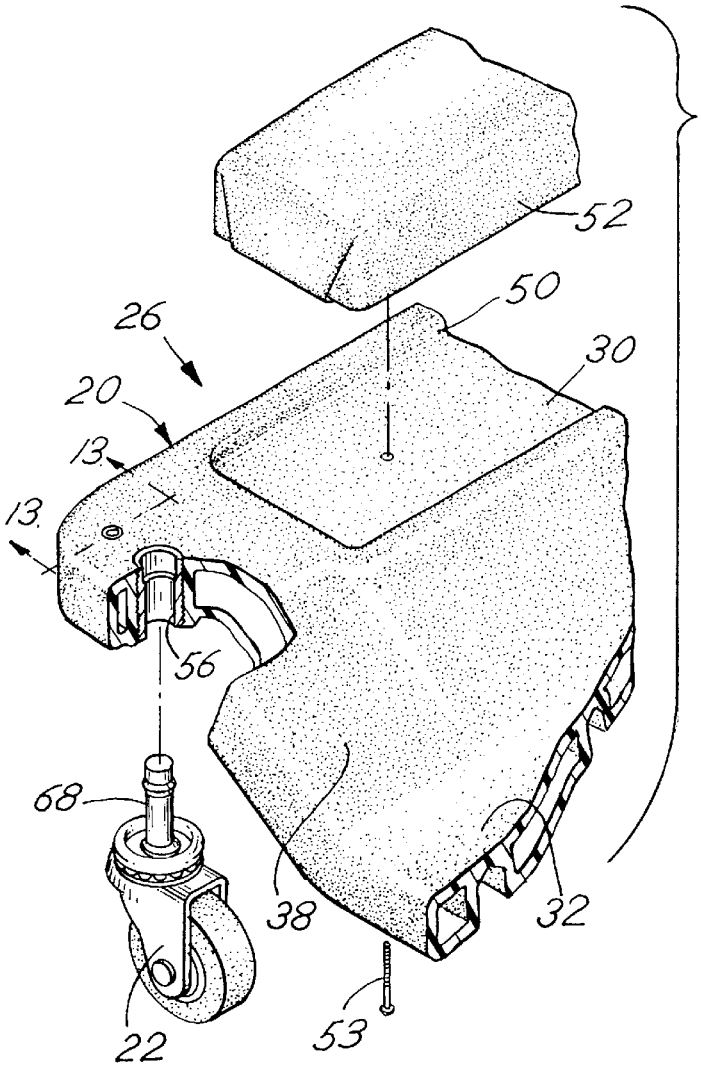
FIG.10
FIG.13
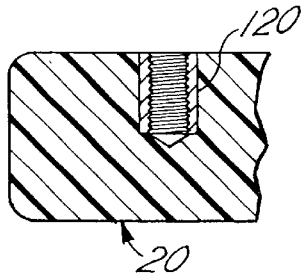
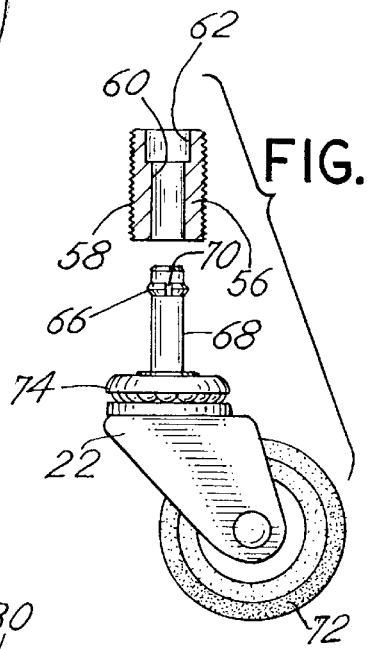
FIG.11
FIG.12
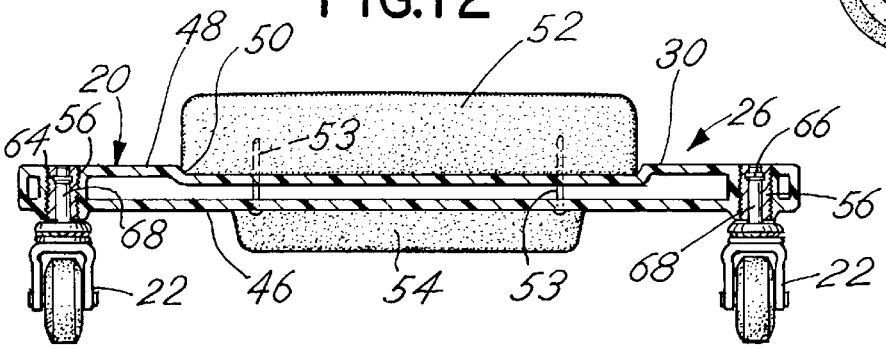

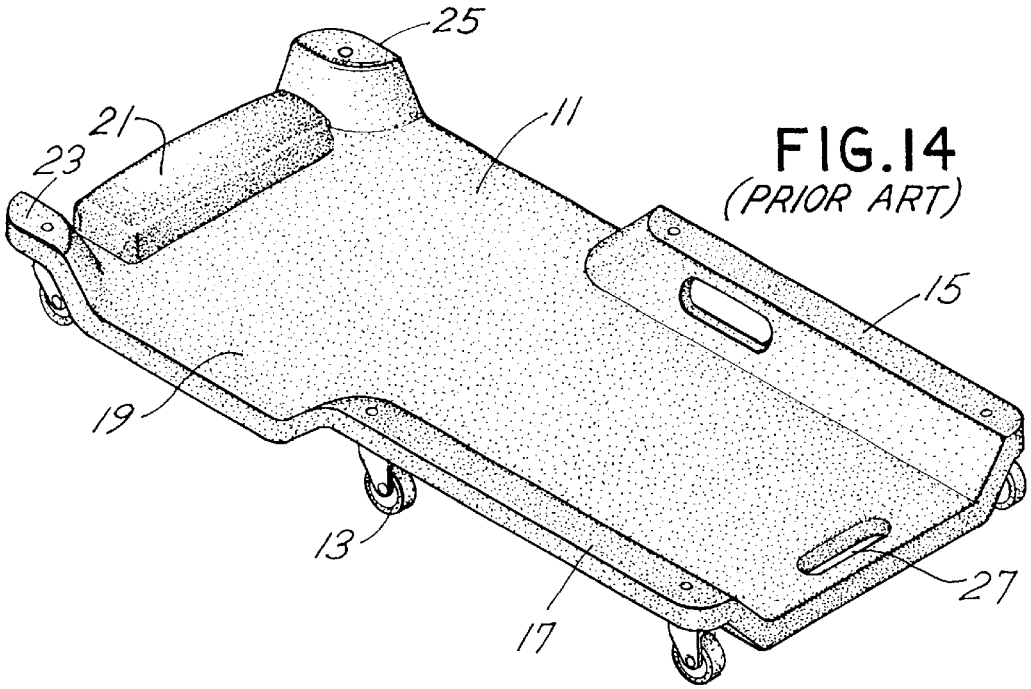
FIG. 14
(PRIOR ART)
FIG. 15
(PRIOR ART)
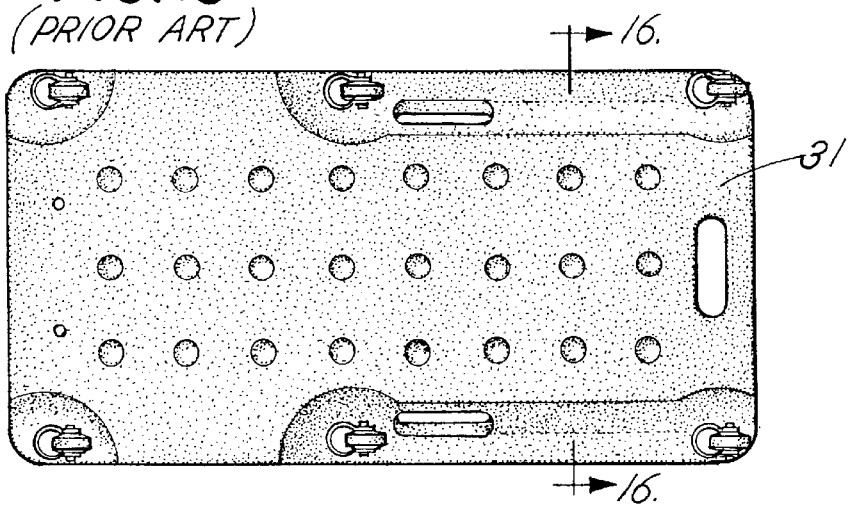
FIG. 16
(PRIOR ART)
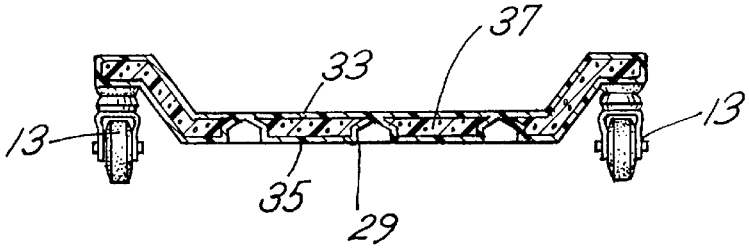

MECHANIC'S CREEPER CONSTRUCTION

CROSS REFERENCE TO RELATED APPLICATION

This is a continuation of application Ser. No. 09/527,547 filed Mar. 16, 2000 which is a continuation of application Ser. No. 09/065,707 filed Apr. 24, 1998 both now abandoned and for which priority is claimed.

BACKGROUND OF THE INVENTION

This invention relates to a mechanic's creeper construction, and more particularly, to a molded plastic, creeper construction which is shaped to provide enhanced comfort to the user.

Heretofore, mechanic's creepers have been manufactured utilizing a flat wooden board, such as a plywood, material mounted on wheels or mounted on a metal frame. U.S. Pat. No. 5,174,592 discloses a typical construction. Other patents have suggested contouring the creeper platform and manufacture of a creeper platform from a molded plastic material. Patents depicting a contoured creeper platform include U.S. Pat. Nos. 4,792,147 and 5,297,809. and U.S. Pat. No. 5,397,139 also suggests that a mechanic's creeper platform may somehow be contoured in order to facilitate the comfort of the user.

Commercially there are other creeper platform constructions molded from plastic material having various shapes and contours and which have proven to be useful as mechanic's creepers. Molding of a plastic mechanic's creeper platform has also proven to be a technological challenge. When molding a creeper platform, quite often the molding technology provides that the outer layer or skin of the creeper platform will be molded from a polyethylene material and the inner core of the creeper platform will be stiffened by means of urethane plastic injected into the core of the polyethylene envelope. Molding processes for the manufacture of such products typically comprise injection molding techniques. While such techniques are useful, other molding techniques such as rotational molding may have additional benefits in terms of the form of the creeper platform which may be manufactured.

Thus there has remained a number of reasons why an improved mechanic's creeper would be useful and desirable in the market place.

SUMMARY OF THE INVENTION

Briefly, the present invention relates to a mechanic's creeper molded from plastic and designed to receive and support a person working in a reclined position. The creeper includes a molded plastic platform or cradle with a plurality of wheels attached to the periphery of the platform for support of the platform and for permitting easy movement of the platform by the person thereon. The platform is preferably molded by a rotational molding technique or process and includes an upper or top layer and a lower or bottom layer. The layers are separated one from the other by a hollow space which defines the thickness of the platform. The lower bottom layer includes a pattern of indentations arrayed therein which extend toward the top layer and are fused thereto. This structure provides mechanical integrity to the platform. The platform is configured into at least three distinct areas: a generally flat shoulder area adjacent one end, a curved lumbar support area in the middle, and a curved, buttocks support area at the other end. An elevated headrest is provided adjacent the shoulder area. Casters are strategically positioned about the periphery of the platform and inserted into cylindrical, metal, retaining bushings molded into the platform. The casters include a stem with a compression ring on the stem that fits into and engages with a slot or counterbore in the bushing. Hand holes and a cleat are molded into the platform to facilitate carrying thereof.

Thus it is an object of the invention to provide an improved mechanic's creeper construction.

Another object of the invention is to provide a mechanic's creeper construction having a low profile which includes a platform made from a molded plastic material such as polyethylene.

Yet a further object of the invention is to provide a mechanic's creeper with a platform that may be manufactured by rotational molding techniques.

A further object of the invention is to provide a mechanic's creeper which is adapted to include a number of casters positioned about the periphery of the creeper platform.

Another object of the invention is to provide a mechanic's creeper construction wherein the creeper platform may be manufactured by a molding process.

Another object of the invention is to provide a creeper comprised of an upper or top layer and a lower or bottom layer with a hollow space between the layers and with indentations projecting from the bottom layer toward or into the top layer to enhance mechanical rigidity and stability.

Another object of the invention is to provide a mechanic's creeper which may be utilized in combination with various creeper enhancements such as a head cushion, tool holders and the like.

A further object of the invention is to provide a mechanic's creeper which is easily manufactured, economic and rugged.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 10 is an exploded perspective view of the platform and caster in FIG. 1;

FIG. 11 in a cross sectional view of the bushing and caster connection taken along the line 11—11 in FIG. 2;

FIG. 12 is a cross sectional view of the head support section of the creeper platform taken along the line 12—12 in FIG. 1;

FIG. 13 is a cross sectional view along the line 13—13 in FIG. 10;

FIG. 14 is a perspective view of a molded prior art mechanic's creeper;

FIG. 15 is a bottom plan view of the creeper of FIG. 14; and

FIG. 16 is a cross sectional view of a prior art mechanic's creeper of FIG. 15 taken substantially along the line 16—16 in FIG. 15.

DETAILED DESCRIPTION OF THE PREFERRED EMBODIMENT

Figure 1:
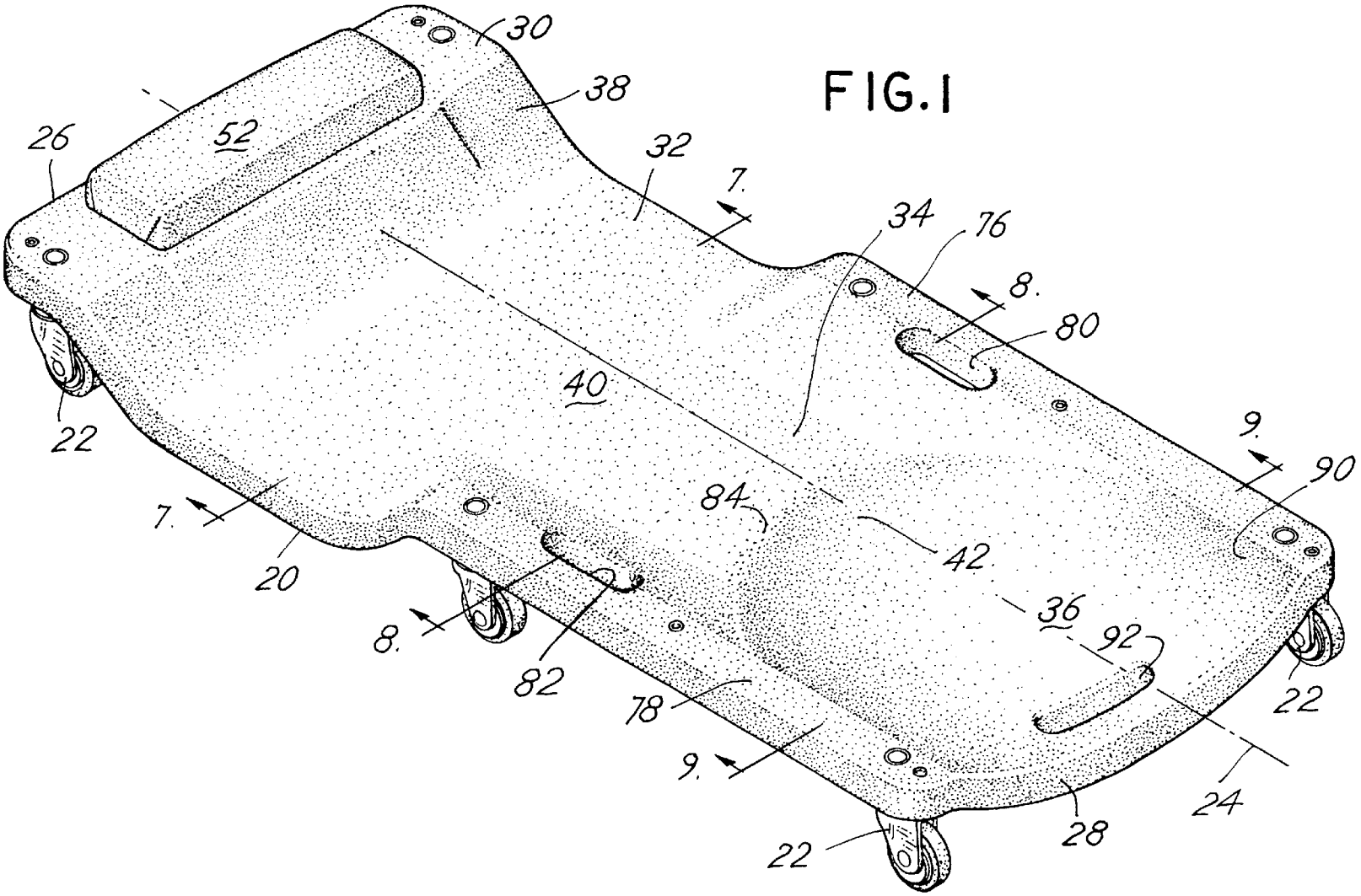
FIG. 1 is an perspective view of the creeper of the invention.
Figure 2:
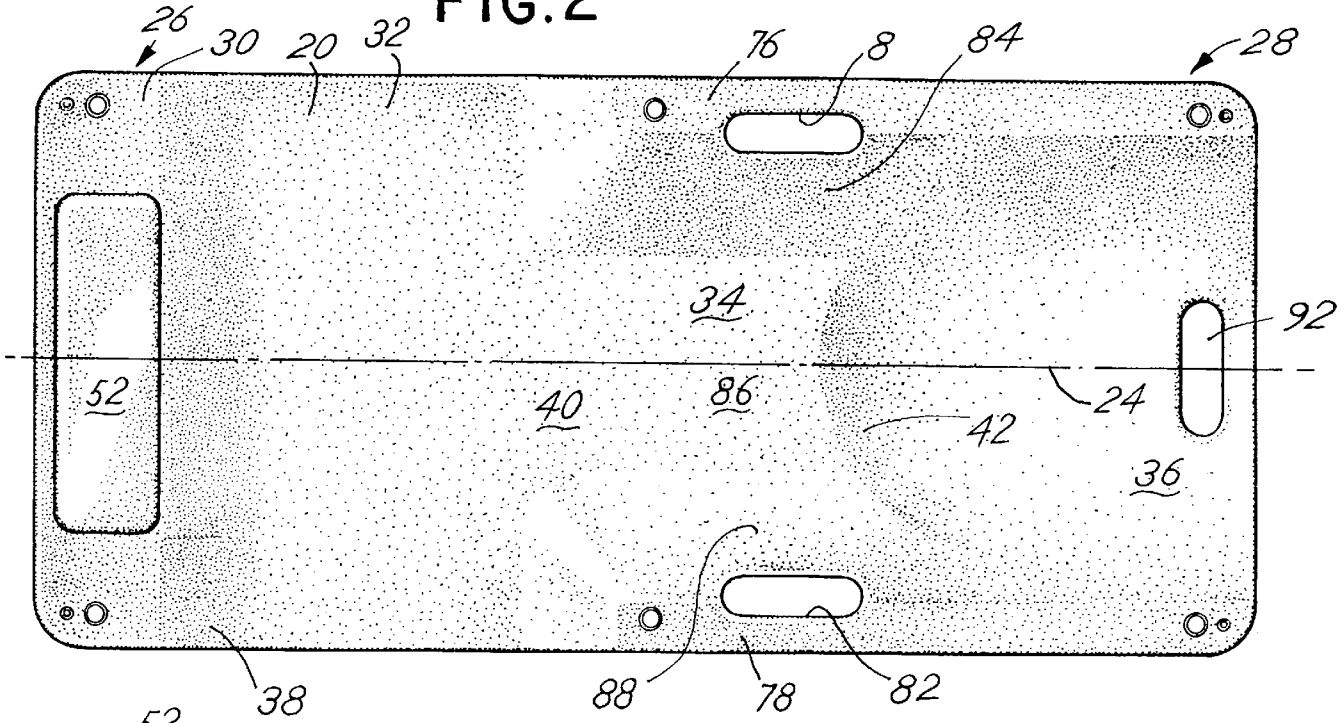
FIG. 2 is an top plan view of the creeper of FIG. 1.
Figure 3:
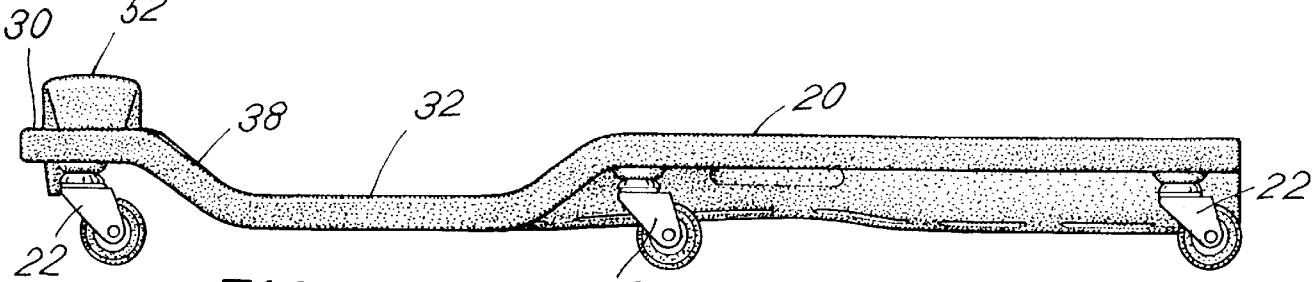
FIG. 3 is a side elevation of the creeper of FIG. 1.
Figure 6:
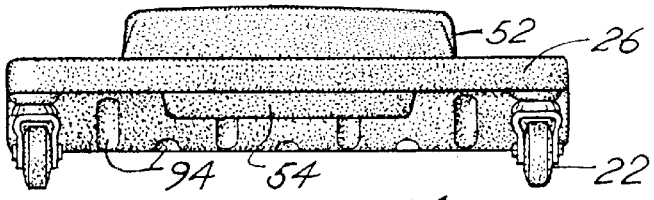
FIG. 6 is a foot end view of the creeper of the invention.

FIGS. 14–16 illustrate a known molded plastic, mechanic's creeper construction. The creeper includes a platform 11 which is generally planar. Casters 13 are attached at strategic positions about the periphery of the platform. More particularly, the platform 11, which is generally planar, includes horizontal side sections or subplatforms 15 and 17 which are generally parallel and are spaced one from the other along the opposite sides of the platform 11. The side sections 15, 17 are elevated relative to platform 11 and spaced so that a mechanic may position his lumbar section and buttocks between the side sections 15, 17. The shoulders of the mechanic are placed on the flat upper section 19 of platform 11. A headrest 21 is positioned between elevated caster engaging sections or subplatforms 23, 25. Sections 23, 25 are in the same horizontal plane as sections 15, 17. A handhold 27 is molded at the foot end of the mechanic's creeper in platform 11.

As shown in FIG. 16, the prior art mechanic's creeper includes molded projections 29 which are generally circular in configuration and are arranged in a pattern as shown in FIG. 15 on the bottom surface 31 of the creeper. The molded creeper platform 11 has a top layer or skin 33 and a bottom layer or skin 35 with a space between layers 33 and 35 filled with a second plastic material, such as urethane foam 37, to improve the rigidity of the creeper and to prevent unwarranted or undesired bending and contortion thereof.

Referring now to FIGS. 1–13, there is illustrated an embodiment of the mechanic's creeper of the invention. The mechanic's creeper of the invention is comprised of a molded plastic creeper platform 20 and a plurality of casters 22 which are attached to the platform 20. The casters 22 fit into bushings 56 which are molded into the platform 20. The casters 22 are preferably metal or at least have a metal stem 68, as described below, and co-act with the metal bushings 56 which are molded into the platform 20, again as described below.

Thus, referring to the figures, the platform 20 has a longitudinal, center line axis 24 extending from a head end 26 through a foot end 28 of the platform 20. Intermediate ends 26 and 28 are four sections of the platform 20. These four sections each have a different shape or curvature. Thus, there is a first or head section 30 which is joined to a second or shoulder section 32. The shoulder section 32, in turn, is joined to a lumbar or lumbar support section 34. The lumbar section 34, in turn, is joined to a buttocks section 36 which is adjacent the foot end 28. The total axial dimension or length of the platform 20 is typically in the range of 36 to 39 inches though this dimension may be varied according to desires and needs.

The head section 30 is smoothly joined to the shoulder section 32 by a transition section 38. A second transition 40 joins the shoulder section 32 to the lumbar section 34. A third transition section 42 joins the lumbar section 34 to the buttocks section 36, though the third transition section 42 may be omitted and lumbar section 34 may be directly joined to buttocks section 38.

Each of the sections and transitions has a different cross-sectional shape or configuration in a direction transverse to the axis 24. FIGS. 7, 8, 9 and 12 generally depict the cross-section shape of the shoulder section 32, the lumbar section 34, the buttocks section 36 and head section 30 respectively. Referring first to FIG. 12, therefore, the head section 30 is defined by a generally flat, planar platform transverse to the axis 24. Thus the head section 30 includes a bottom molded layer 46 opposed and spaced from a top molded layer 48. The layers 46 and 48 are continuous top and bottom layers 46 and 48 and are joined together with the other sections described below and with each other along the edges of platform 20 and further as described below. The platform 20, and thus the layers 46 and 48, are formed or molded in a rotational molding process. The top layer 48 of the head section 30 includes a recess 50 which is rectangular in shape. The recess 50 receives a head cushion 52 attached by fastener 53. Cushion 52 is also generally rectangular, for the comfort of the mechanic utilizing the creeper apparatus.

The bottom layer 46 is generally planar and is spaced from the top layer 48. A cleat 54 is molded into the bottom layer 46 beneath the depression or recess 50. The cleat 54 is provided for the purpose of manual gripping and holding of the platform 20 and carrying the platform 20 or creeper.

Metal bushings, such as bushings 56, are molded into the sides of the head section 30 and are adapted to receive the casters 22. The bushings 56 are generally cylindrical metal members which include exterior surface knurling 58 to grip and adhere to the plastic into which they are molded. An inside passage 60 of each bushing 56 is generally cylindrical and may include a top counterbore 62 or a slot 64 for cooperation with a compression ring 66 fitted around and held on a stem 68 of caster 22. The stem 68 thus includes a receiving slot 70 for the compression spring 66. Reference is also made to FIG. 11 for depiction of this construction of the caster 22 which includes wheel 72 supported by the stem 68 connected thereto through a bearing, pivot connection 74 of a type known to those of ordinary skill in the art. The caster 22 and bushing 56 constructions are substantially identical with respect to all of the casters 22 attached to the platform 20 about the periphery of the platform 20.

In the embodiment depicted, there are six casters 22 which are uniformly spaced along the opposite sides of the platform 20. Thus a first set of casters 22 is positioned opposite sides of the head section 30. A second set of casters 22 is positioned on opposite sides of the lumbar section 34 and a third set of casters 22 is positioned on opposite sides of the buttocks section 36 at the foot end 28 of the platform 20. Additional sets of casters 22 may be used. It is preferred that the casters 22 be arranged opposite one another on opposite sides of the axis 24 as depicted with a first set of the head end 26, a second set supporting the lumbar section 34 in the middle of platform 20 and a third set at the foot end 28. Other patterns of casters 22 and numbers of casters 22 may, however, be used.

It is further preferred that the casters 22 be of equal size and in a single, common plane associated with the head section 30, lumbar section 34 and at the foot end 28. This results because the platform 20 includes planar sections, namely the head section 30 and planar side or lateral sections 76 and 78 which are all generally co-planar so that an equally sized caster 22 may be utilized to support the platform 20 equally and uniformly above a surface level. Thus the side sections 76, 78 and the head section 30 together form a triangular set of sections or portions of the platform 20 to provide support of the platform 20 in a manner which precludes the platform 20 from tipping or becoming inappropriately oriented by the user upon movement while additionally maintaining the shoulder section 32 open or available to be generally flat as that shoulder section 32 across the width of the platform 20.

The shoulder section 32 is immediately adjacent section to the head section 30. The shoulder section 32 has a length in the range of nine to fourteen inches preferably. The shoulder section 32 is at a lower elevation than the head section 30 and extends substantially to the lowest elevation along the longitudinal axis 24. The shoulder section 32 is generally flat across the width of the platform 20 although it may be slightly contoured to fit the shoulders of a user. Preferably the shoulder section 32 is flat across the entire width of the platform 20. A smoothly curved, downwardly extending transition section 38 connects head section 30 to shoulder section 32.

Similarly, a smoothly curved, second transition section 40 connects the shoulder section 32 to lumbar section 34. The longitudinal extent of first transition section 38 is in the range of three to four inches. Similarly, the longitudinal extent of the second transition section 40 is three to four inches.

Figure 8:
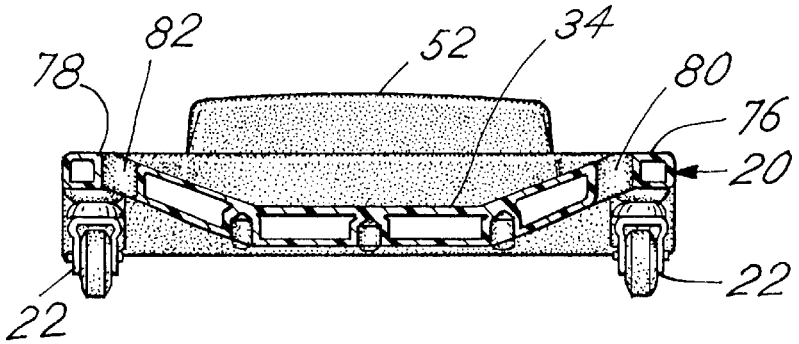
FIG. 8 is a cross sectional view of the creeper taken along the line 8—8 in FIG. 1.

The next adjacent section which conforms with the body of a mechanic or user of the platform 20 is the lumbar support section 34. As depicted in FIG. 8, the lumbar support section 34 includes the flat, planar, side sections 76 and 78 which are at the same elevation as the head section 30. Hand holes 80 and 82 are molded into the side sections 76, 78 and a portion of the lumber section 34. The lumbar section 34 further includes a transverse, slightly curved portion 84 connecting the elevated, planar side section 76 with a generally flat, lower back support section 86 which is longitudinally aligned with the axis 24. A similar slightly curved, or flat, inclined side transition section 88 connects the lower back or lumbar flat portion 86 to the flat horizontal planar side section 78. The side sections 84 and 88 are thus lumbar support portions which are designed to confirm, to the maximum extent possible, to the average mechanic's back and help provide side support.

The next or third transition section 42 connects the lumbar section 34 with the buttock section 36. The third transition section 42 may be minimal in longitudinal axial extent or may be omitted altogether. Typically, the longitudinal extent of section 42 is in the range of one to two inches.

Figure 9:
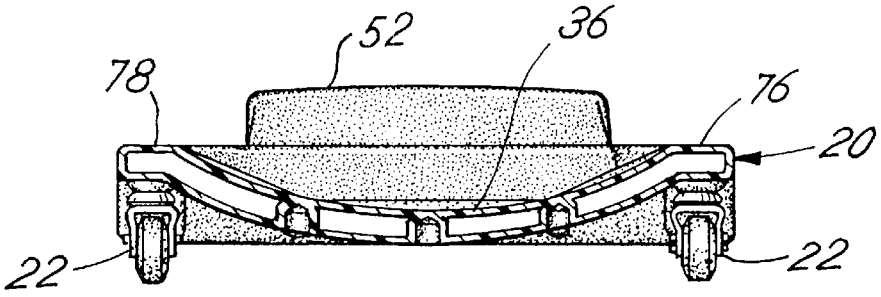
FIG. 9 is a cross sectional view of the creeper taken along the line 9—9 in FIG. 1.

The buttock support section 36 is curved or arcuate in cross section as illustrated in FIG. 9. The buttock section 36 thus includes an arcuate section 90 which extends between the flat, horizontal, planar side support sections 76, 78. Positioned at the foot end 28 in the buttock section 36 is a hand hole 92 which connects the lower or bottom layer 46 and the top layer 48. The hand hole or opening 92 is transverse to the axis 24. Thus the hand opening 92 extends equally on opposite sides of the axis 24.

The arcuately curved portion 90 of the buttocks section 36 has a configuration conforming to the buttocks of a human and permits some sliding movement of the user of the creeper on the platform 20, thereby enabling the user to find the most comfortable position on the platform 20. The buttock support section 36 thus has an axial extent of 10–14 inches which permits sliding by the user and provides enhanced support.

The bottom layer 46 of the platform is generally spaced from the top layer 48. However, the bottom layer 46 further includes a pattern of elongated indentations 94 which are molded therein and which extend from the bottom layer 46 upward to engage or merge with or touch the top layer 48 as a result of the molding process. The indentations 94 provide mechanical stability and rigidity to the platform 20. Thus the configuration and pattern of the indentations 94 constitutes an important part of the construction of the platform 20.

Figure 5:
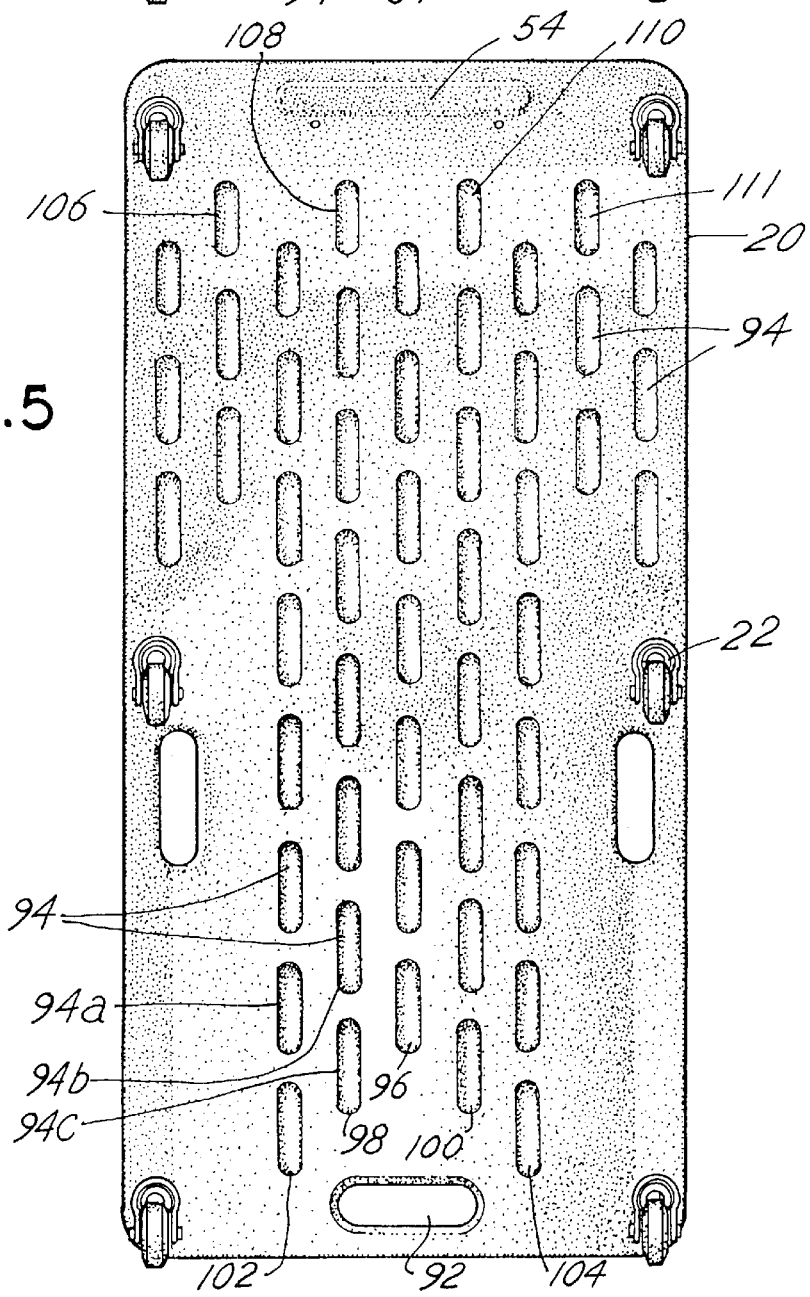
FIG. 5 is a bottom plan view of the creeper of the invention.
Figure 4:
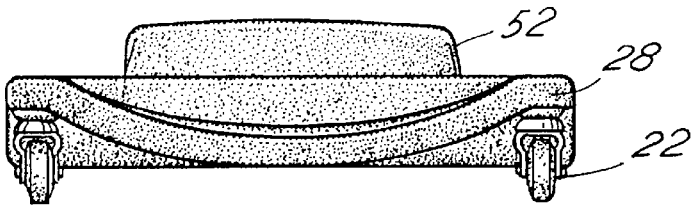
FIG. 4 is a head end view of the creeper of the invention.
Figure 7:
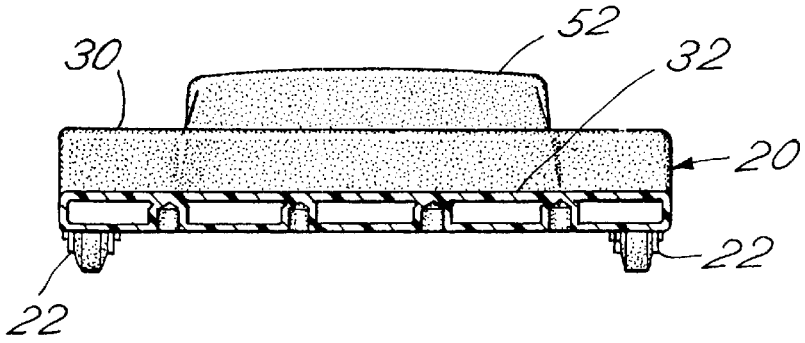
FIG. 7 is a cross sectional view of the creeper taken along the line 7—7 in FIG. 1 which is along the longitudinal axis of the creeper.

Specifically, each indentation 94 is elongated and generally parallel to the axis 24. The width of each indentation 24 is approximately one-fourth to one-sixth of its length. The indentations 94 are spaced one from the other approximately one-quarter to one-third of the axial length of each indentation 94. The indentations are arrayed in rows parallel to or overlying the axis 24. Each of the rows is spaced from the adjacent row by a distance in the range of three to four times the width of each indentation 94. A medial or axial row 96 overlies or is congruent with the axis 24 and parallel rows are equally spaced on opposite sides of the center row 96 of indentations 94. Thus center row 96 is flanked by spaced parallel rows 98 and 100. These in turn, are flanked by spaced rows 102 and 104. The rows 96, 98, 100, 102 and 104 all extend substantially the length of the platform 20 between the head section 30 and the foot end 28. The shoulder section 32 includes further parallel rows of indentations 106, 108, 110 and 112 Preferably, the indentations 94 of adjacent rows overlie two indentations of the next adjacent row By way of example, indentation 94(*a*) axially overlies indentation 94(*b*) and 94(*c*) as depicted in FIG. 5. This pattern of indentations 94 or the array of the pattern on the bottom layer 46 merging into the top layer 48 promotes structural integrity of the platform 20, not previously achieved, and permits the elimination of a stiffening material between the layers 46 and 48. Thus, use of a urethane plastic stiffening material inserted between the layers 46 and 48 is not required or necessary with the construction of the present invention. It is noted that the bottom layer 46 is spaced from the top layer 48 approximately the distance of the width of an average indentation 94 in the preferred embodiment.

However, variations of the construction are possible. The pattern of indentations 94 may be altered or varied. The shape, length, array and arrangement of the indentations 94 may be varied. The number of rows and their arrangement may be varied. The size, spacing, shape and dimensions thereof may also be varied in order to maximize the mechanical integrity of the platform 20. The size and positioning of hand holes 82 and 92 may also be varied inasmuch as the hand holes also provide and enhance the mechanical rigidity of the platform 20. Similarly, the number and position of cleats such as cleat 54 may be altered and varied without departing from the scope of the invention.

FIG. 13 illustrates a further feature. Threaded bushings 120 may be molded into the platform 20 at strategic positions in the platform 20 for receipt of auxiliary items such as tool holders, etc. (not shown). The position, number and array of such bushings may be varied. Threading is optional and various shapes may be used.

Thus, there are many variations of the invention and the invention is to be limited only by the following claims and their equivalents.

What is claimed is:

1. A mechanic's creeper comprising, in combination:

a molded plastic creeper platform, a plurality of wheels attached to said platform adjacent the periphery of said platform;

said platform having a generally rectangular plan view configuration and including a head end, a foot end and a longitudinal centerline axis extending from the head end to the foot end of the platform, said platform formed as a single hollow molded plastic unit and having a top surface layer and a bottom surface layer of plastic, said top layer being generally smooth on the outside and the bottom layer including a plurality of indentations projecting toward and contacting the top layer to enhance the rigidity of the platform with the space between the layers being otherwise hollow;

the top layer having a surface profile which changes along the longitudinal axis and includes at least three distinct and connected sections joined to a head section at said head end, said three distinct and connected sections comprising:

(a) a shoulder section adjacent the head end and extending axially from said head section, said shoulder section being generally flat transverse to the axis across the width of the platform;

(b) a lumbar support section axially adjacent the shoulder section and positioned toward the foot end, said lumbar support section elevated relative to the shoulder section, but not relative to the head section and including curved side lumbar support portions on each side of the axis; and (c) a buttocks section axially adjacent the lumbar support section and which is not elevated relative to the connected lumbar support section, said buttocks section curved to conform to human buttocks, said curvature extending transverse to the axis and extending from adjacent the lumbar support section to the foot end of the platform;

a transition section intermediate each of the three sections and said head section to effect continuous connection thereof;

flat planar sections along the side edges of the platform at the head end, lumbar support section and foot end, said planar sections being co-planar and including equally sized wheels, said wheels attached thereto for uniform platform support;

said head section adjacent the shoulder section being a generally flat planar section coplanar with the planar sections and elevated relative to the shoulder section, said head section including a head support cushion; and said bottom surface layer indentations comprising a plurality of longitudinal indentations arranged in rows parallel to the axis, said indentations extending from the bottom surface layer to the top surface layer to mechanically stabilize the platform, said indentations having a longitudinal length in the range of ⅙ to ¼ the width of said indentations said indentations of adjacent longitudinal rows overlapping longitudinally, said indentations of each row being spaced longitudinally, said adjacent rows of indentations being generally equally spaced, and the width of each indentation being substantially equal to the spacing of the top layer and bottom layer in the region between indentations.

2. The creeper of claim 1 including at least one hand hold extending through the creeper platform along an edge thereof.

3. The creeper of claim 1 including a downwardly projecting cleat from the bottom layer along an edge of the platform for manual gripping and carryng of the platform.

4. The creeper of claim 1 including including cylindrical wheel mounting bushings molded into the platform, a wheel caster with a stem inserted into each bushing, each of said bushings being a generally cylindrical member positioned for receipt of a stem of a wheel caster and including a knurled outside surface and an inside surface having a counterbore, said stem including a compression ring fitted into the counterbore to retain the wheel caster.

* * * * *